US012078381B2

(12) United States Patent
Schreiber

(10) Patent No.: US 12,078,381 B2
(45) Date of Patent: Sep. 3, 2024

(54) AIR HANDLING DEVICE

(71) Applicant: SLD Technology, Inc., Portland, OR (US)

(72) Inventor: Kevin Joseph Schreiber, Portland, OR (US)

(73) Assignee: SLD TECHNOLOGY, INC., Portland, OR (US)

( * ) Notice: Subject to any disclaimer, the term of this patent is extended or adjusted under 35 U.S.C. 154(b) by 0 days.

(21) Appl. No.: 17/529,010

(22) Filed: Nov. 17, 2021

(65) Prior Publication Data

US 2022/0154970 A1 May 19, 2022

Related U.S. Application Data

(60) Provisional application No. 63/115,012, filed on Nov. 17, 2020.

(51) Int. Cl.

| | |
|---|---|
| ***F24F 13/14*** | (2006.01) |
| ***F24F 11/00*** | (2018.01) |
| ***F24F 11/30*** | (2018.01) |

(52) U.S. Cl.

CPC ..... *F24F 13/1426* (2013.01); *F24F 11/0001* (2013.01); *F24F 11/30* (2018.01); *F24F 2013/1473* (2013.01)

(58) Field of Classification Search

CPC .... F24F 13/1426; F24F 11/0001; F24F 11/30; F24F 2013/1473; F24F 11/32; F24F 13/0272; F24F 11/89; F24F 7/06; F24F 2007/005; F24F 13/0236; F24F 2221/36

See application file for complete search history.

(56) References Cited

U.S. PATENT DOCUMENTS

| | | | | |
|---|---|---|---|---|
| 5,117,899 A * | 6/1992 | Skimehorn | F24F 3/052 55/DIG. 35 |
| 5,244,193 A * | 9/1993 | Hehr | F16B 35/06 411/84 |
| 2011/0042055 A1* | 2/2011 | Bauer | F24F 3/0522 236/1 C |
| 2022/0034527 A1* | 2/2022 | Shamshoian | F24F 13/10 |

FOREIGN PATENT DOCUMENTS

| | | | |
|---|---|---|---|
| KR | 20190109640 A * | 9/2019 | |
| WO | WO-0150069 A1 * | 7/2001 | F24F 13/20 |

OTHER PUBLICATIONS

AHU Viewport Access Door, Sep. 21, 2020, Ductmate Industries https://ductmate.com/product/ahu-viewport-access-door-panel/ (Year: 2020).*

* cited by examiner

*Primary Examiner* — Edelmira Bosques
*Assistant Examiner* — Michael James Giordano
(74) *Attorney, Agent, or Firm* — Burris Law, PLLC

(57) ABSTRACT

An air handling device includes a plurality of tunnels defining a plurality of separate air flow pathways. At least one tunnel of the plurality of tunnels is an active tunnel and at least one tunnel of the plurality of tunnels is a redundant tunnel. The air handling device further includes a first air select at a first end of the plurality of tunnels and a second air select on a second end of the plurality of tunnels, wherein the first end is opposite to the second end. The air handling device also includes a plurality of dampers within each of the first and second air selects, wherein the plurality of dampers are configured to change an air flow therein to block air flow through the active tunnel and allow air flow through the redundant tunnel.

20 Claims, 11 Drawing Sheets

AIR HANDLING DEVICE

CROSS-REFERENCE TO RELATED APPLICATIONS

This non-provisional application claims the benefit of and priority to U.S. Provisional Application No. 63/115,012, filed Nov. 17, 2021. The disclosure of the prior application is hereby incorporated by reference herein in its entirety.

BACKGROUND

Heating, venting, and air conditioning (HVAC) systems typically include a single air handling unit (AHU) that feeds a main trunk and branches off to separate areas of a building unit, such as different rooms. Accordingly, each separate room is interconnected to the AHU and each other room that branches from the AHU. Because all the rooms are interconnected, the failure of any component of the AHU can lead to failure for all the rooms and a contamination of one room can lead to the contamination of all the rooms. The failure or contamination can have significant adverse results when implemented in emergency services areas, such as operating rooms and emergency rooms.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In various embodiments, an air handling device includes a plurality of tunnels defining a plurality of separate air flow pathways. At least one tunnel of the plurality of tunnels is an active tunnel and at least one tunnel of the plurality of tunnels is a redundant tunnel. The air handling device further includes a first air select at a first end of the plurality of tunnels and a second air select on a second end of the plurality of tunnels, wherein the first end is opposite to the second end. The air handling device also includes a plurality of dampers within each of the first and second air selects, wherein the plurality of dampers are configured to change an air flow therein to block air flow through the active tunnel and allow air flow through the redundant tunnel.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

The examples disclosed herein may take physical form in certain parts and arrangement of parts, and will be described in detail in this specification and illustrated in the accompanying drawings which form a part hereof and wherein.

DETAILED DESCRIPTION

Figure 1:
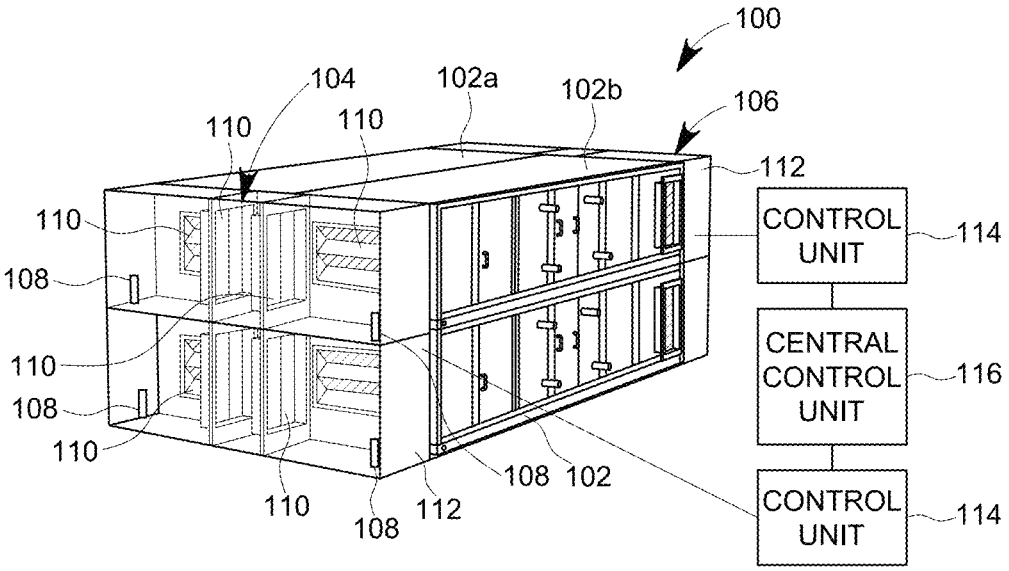
FIG. 1 illustrates an air handling device according to various embodiments of the present disclosure.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Various embodiments of the present disclosure provide a modular air handling device that eliminates cross-contamination between separate rooms and builds in redundancy via an air-redirection device. For example, the modular air handling device includes multiple independent air tunnels and an air redirection device which are all modularly connected within the air handling device. The modular arrangement including the air redirection device allows air to be redirected from any individual air tunnel to any other individual air tunnel by opening and closing dampers between the air tunnels and the air redirection device, and within the air redirection device itself.

As described herein, various embodiments of the present disclosure reduce or eliminate the possibility of cross-contamination in common ductwork between rooms. This reduces or eliminates the likelihood of infections from airborne particulates in a common supply and/or return duct and potentially increases the return on investment for a particular system. Various embodiments of the present disclosure further reduce or eliminate the need for variable air volume (VAV) terminal devices and associated piping between the air handler(s) and room(s). Various embodiments of the present disclosure further lower energy expenses due to reduced static in the system and increased controllability. Various embodiments of the present disclosure further provide instant feedback and adjustment due to direct connections to sensed environments and human created input requests for environmental changes. Various embodiments of the present disclosure further provide smaller individual air tunnels with smaller individual components, requiring less time for maintenance and service, which further increases the return on investment for a user and provides an improved user experience. Various embodiments of the present disclosure further allow individual air tunnels to be transported through tighter and more efficient move-in paths and can be stacked or affixed in place at the point of installation of the unit. Various embodiments of the present disclosure further enable humidification at an air flow point of entry to a distribution manifold.

As described herein, various embodiments of the present disclosure provide built-in redundancy to provide more streamlined, efficient HVAC solutions than current solutions. In particular, one or more embodiments of the present disclosure can be implemented to comply with redundancy requirements of local, state, and international governments at a fraction of the cost and size as current solutions. Current locations that are required to have n+1 redundancy in HVAC air handlers, for example, typically purchase two air handlers to meet the n+1 redundancy requirements, doubling the size, footprint, and cost of the unit itself. As implemented, various embodiments of the present disclosure enable the n+1 requirements to be met, while decreasing the size of a unit by using smaller, more efficient components that are easier to maintain and use. For example, the size of the components described herein allows maintenance to be performed by a single person rather than a team of multiple individuals with heavy equipment.

FIG. 1 illustrates an air handling device 100 according to various embodiments of the present disclosure. The air handling device 100 includes a plurality of individual, separate tunnels 102, or manifolds, that are modularly connected, a first air select 104, and a second air select 106. The first air select 104 is provided on a first end of the air handling device 100, lengthwise, and the second air select 106 is provided on a second end of the air handling device 100, lengthwise, opposite the first air select. That is, each end of the air handling device 100 includes a corresponding air select 104, 106 that is configured to selectively control air flow as described in more detail herein.

More particularly, the first air select 104 is configured to monitor and control the output of air from each tunnel 102 to a respective room (thereby defining separate air flow pathways), such as an operating room, while the second air select 106 is configured to monitor and control the return of air from each room, such as the operating room, back to the respective tunnel 102. In other words, the first air select 104 functions as an air exit select and the second air 106 select functions as an air return select. Each air select 104, 106 includes a monitor and control unit 114 for each particular tunnel 102 and a central unit 116 that can redirect air from the unit of a tunnel 102 to a particular room, such as the operating room. In some examples, each air select 104, 106 includes one or more components such as one or more air flow sensors 108 to sense air flow, air quality, etc., and one or more air flow controls, illustrated as damper 110 that can selectively adjust air flow. As can be seen, the dampers 110 can be positioned to control air flow into and out of a respective tunnel 102, as well as between tunnels 102 through a housing 112 (e.g., end cap housing) of the each air select 104, 106.

In some embodiments, one of the tunnels 102 is designated as redundant and on standby. In other words, one or more tunnels 102 are not connected to a particular room, but act as a backup tunnel 102 in the event of contamination or mechanical failure. For example, if a first operating room is found to be contaminated, the original tunnel 102*a* can be closed off and the redundant tunnel 102*b* can be enabled to continue service to the first operating room without contaminating the other operating rooms serviced by the air handling device 100. Thus, each tunnel 102 includes the damper 110 placed in the connection between the tunnel 102 and the respective unit of the first air select 104 that can be opened or closed to control the flow of air out of the tunnel 102. Furthermore, the first air select 104 includes one or more separate dampers 110 from each respective unit to the central unit. This arrangement allows the contaminated tunnel 102*a* to be shut off via the associated damper 110 to the tunnel 102*a* and air to be routed from the redundant tunnel 102*b*, through a respective unit, into the central unit, and to the ductwork so that clean air can continue to be supplied to the room without affecting the status of simultaneously used rooms. It should be noted that one or more air flow sensors 108 and one or more dampers 110 can be positioned on the side of the air handling device 100 having the second air select 106.

The air handling device illustrated in FIG. 1 includes four tunnels 102, of which one tunnel 102*b* is redundant. However, any suitable arrangement of tunnels 102 within the air handling device 100 can be used without departing from the scope of the present disclosure. For example, the air handling device 100 can include six tunnels 102 arranged in a three by two arrangement, six tunnels 102 arranged in a two by three arrangement, eight tunnels 102 arranged in a four by two arrangement, eight tunnels 102 arranged in a two by four arrangement, or any other suitable number of tunnels 102 used for a particular implementation.

Figure 2:
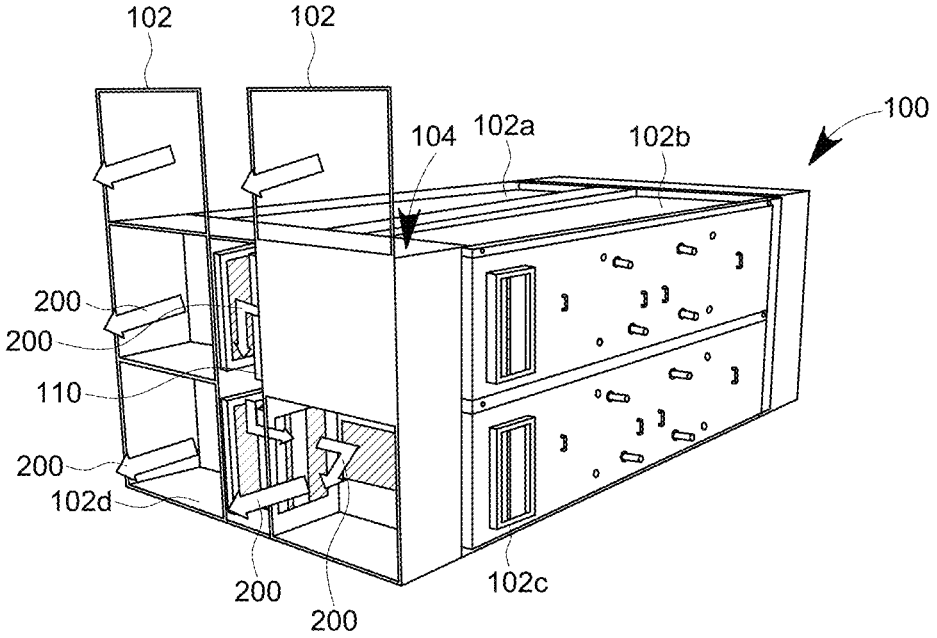
FIG. 2 illustrates an air pathway through the air handling device of FIG. 1 to various rooms using a redundant tunnel.

FIG. 2 illustrates an air pathway 200 (illustrated by the arrows) through the air handling device 100 to various rooms using the redundant tunnel 102*b*. The air handling device 100 illustrated in FIG. 2 includes six tunnels 102 in an arrangement including two tunnels 102 across and three tunnels 102 stacked on top of one another (with the top two tunnels 102 showing juts an end thereof for ease in illustration). In the illustration in FIG. 2, the right tunnel 102*b* in the middle row is redundant while the right tunnel 102*c* in the bottom row has had a failure. As noted above, the failure can include a mechanical failure, a contamination of the air in the room serviced by the tunnel 102*c*, or any other failure. As shown in FIG. 2, the damper 110 for the failed tunnel 120*c* to the first air select 104 is closed and the damper 110 for the redundant tunnel 102*b* to the first air select 104 is opened. While each other damper 110 connected to the first air select 104 remains closed, the damper 110 from the failed tunnel 102*c* to the central unit is opened to allow air to enter and the redundant tunnel 102*b* is able to service the room previously serviced by the failed tunnel. The second air select 106 that provides the return of air from the rooms to the air handling device functions in the same way to provide the return of clean air.

In some embodiments, the air handling device 100 determines when a contamination or failure has occurred and automatically activates the redundant tunnel 102*b* and deactivates the failed tunnel 102*c*. Because the air handling device 100 can perform this process automatically (such as with the central control unit 116), manual, human activation of the redundant tunnel 102*b* is not required. This increases the speed at which the tunnels 102 can be switched so that the chance of a room losing service during an operation is minimized. For example, if manual activation were required, a room could go minutes or even hours without the redundant tunnel 102*b* being activated. This could lead to infection and other serious adverse effects when the air handling device 100 is implemented in an operating room setting. Due to the automatic activation described herein in the present disclosure, this risk is minimized.

Although shown in FIG. 2 with the right tunnel 102*b* in the middle row being the redundant tunnel and the right tunnel 102*c* in the bottom row as failed, any implementation of a redundant tunnel 102 can be used for any particular failed tunnel 102 within the air handling device 100. It should be noted that if the redundant tunnel 102 is already in use (to provide air handling to a failed tunnel), and another tunnel 102 fails, the additional failed tunnel 102 can just be closed off, or the failed tunnel 102 can be closed off and the redundant tunnel 102 can provide air handling to the additional failed tunnel 102. That is, the air handling capabilities of the redundant tunnel 102 can be used to provide air flow to multiple failed air tunnels 102. In addition, more than one redundant tunnel 102 can be utilized to provide N+2 or N+3 redundancy.

Figure 3:
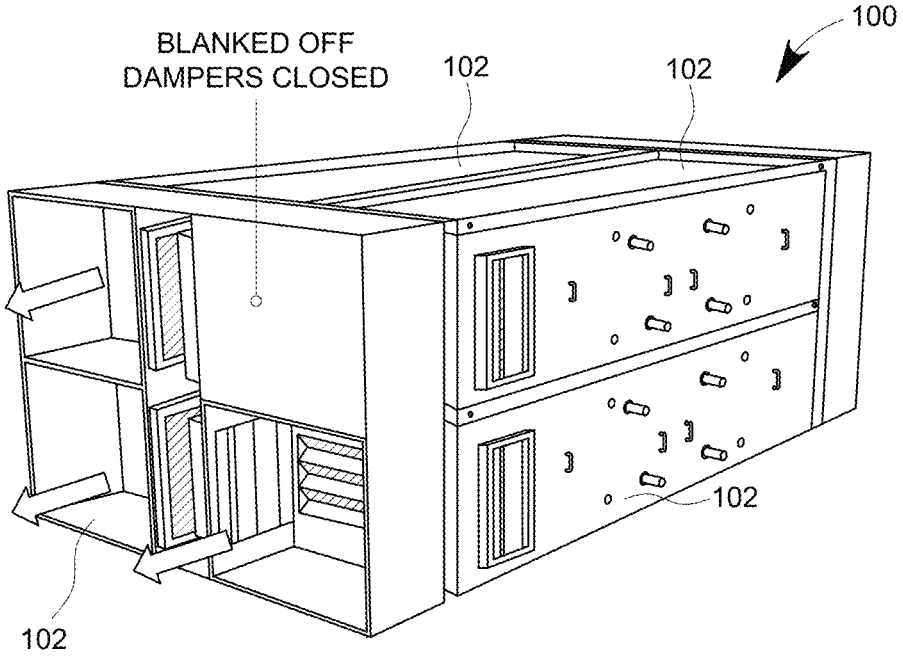
FIG. 3 illustrates the air handling device of FIG. 1 with the redundant tunnel having a closed damper.

FIG. 3 illustrates the air handling device 100 with the redundant tunnel 102*b*, shown in the top right in FIG. 3, closed off, which may be accomplished, for example, using a cover or other seal, closing one or more dampers 110, or some other means. Because the redundant tunnel 102 is closed off, the three active tunnels 102 are understood to be functioning correctly and are not in need of service at the time. That is, one tunnel 102 is available to support one or more of the other tunnels 102 if needed or desired.

Figure 4:
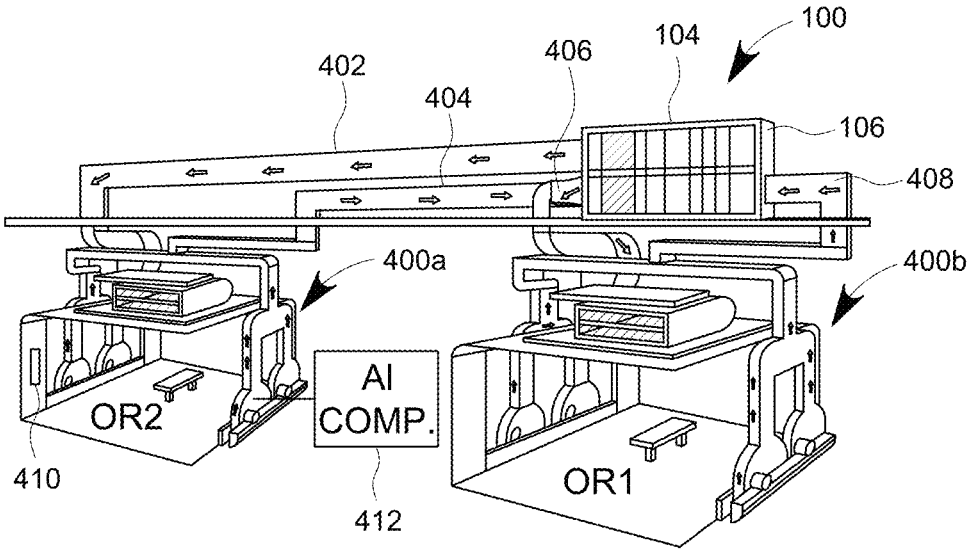
FIG. 4 illustrates the air handling device of FIG. 1 connected to two separate rooms.

FIG. 4 illustrates the air handling device 100 connected to two separate rooms 400. In FIG. 4, the rooms 400 are illustrated as operating rooms (ORs), but the air handling device 100 can service any type, or types, of rooms 400 without departing from the scope of the present disclosure. As shown in FIG. 4, there is one air path 402 leading from the first air select 104 to OR 1 (illustrated as room 400*a*) and one air path 404 leading from OR 1 to the second air select 106. Likewise, FIG. 4 illustrates one air path 406 leading from the first air select 104 to OR 2 and one air path 408 leading from OR 2 to the second air select 106. In some embodiments, the air paths described herein are ductwork that connect the respective OR to the air handling device 100. That is, the ductwork separately connects and forms different independent air flow paths to and from the ORs.

Figure 5A:
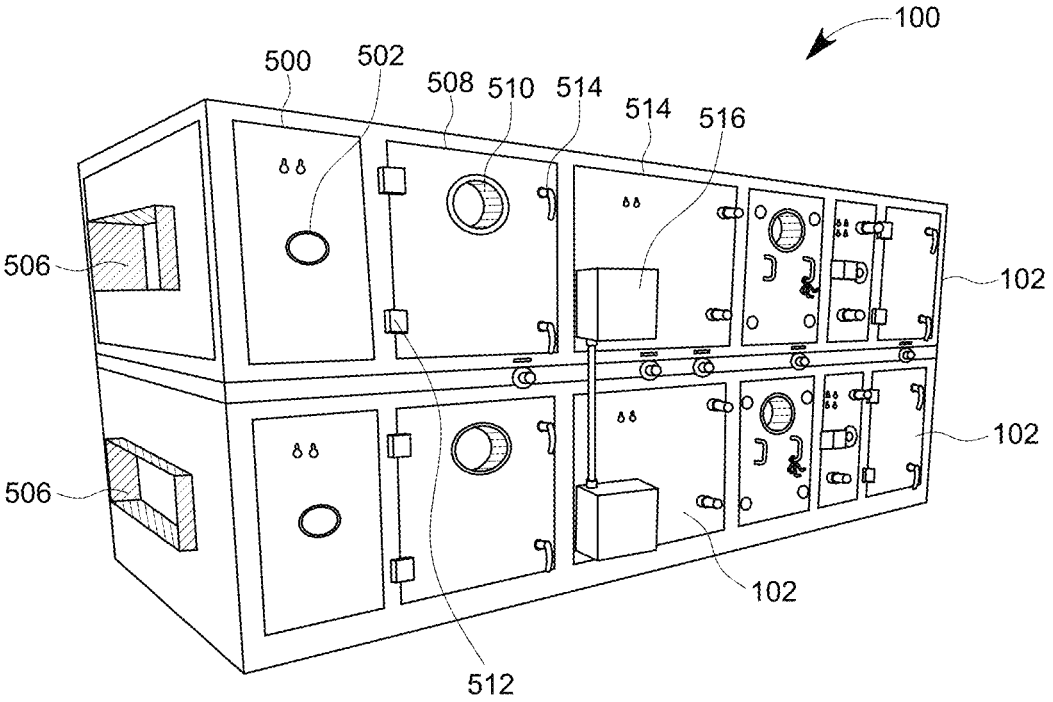
FIG. 5A illustrates two tunnels of an air handling device according to one implementation.
Figure 5B:
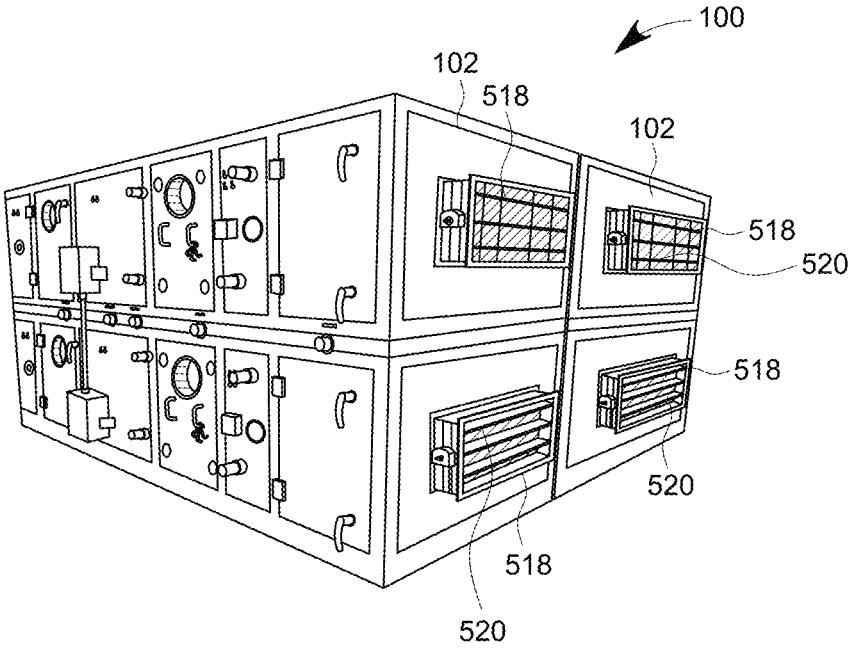
FIG. 5B illustrates the two tunnels of FIG. 5A implemented in a modular design.

FIG. 5A illustrates two tunnels 102 of the air handling device 100 according to various embodiments of the present disclosure. FIG. 5B illustrates the two tunnels 102 of FIG. 5A implemented in a modular, two-by-two design. Although described herein as referring to a single tunnel for simplicity of explanation, the same configuration applies to each modular tunnel 102 that is included in the air handling device 100.

As shown in FIG. 5A, a first panel 500 of the tunnel 102 (corresponding to a first section of the tunnel 102), shown on the left panel when viewing the tunnel from the perspective illustrated in FIG. 5A, includes a gauge 502. In some embodiments, the gauge 502 can be digital or analog and displays various information regarding the tunnel 102. For example, the gauge 502 can display information regarding the temperature, humidity, pressure, particle counts of contaminants, or any other information pertinent to the tunnel 102. In some embodiments, multiple gauges 502 can be provided on the panel 500 to display multiple types of information. In other embodiments, a single gauge 502 can be provided that displays multiple types of information. In some embodiments, the area of the tunnel 102 adjacent to the first panel 500 includes an opening 506 to allow air to flow in or out of the tunnel 102. For example, the opening 506 can be equipped with a damper (e.g., the damper 110) to control the flow of air in or out of the tunnel 102. The opening 506 is some examples leads into the air select 104 illustrated in FIG. 1.

A second panel 508 (corresponding to a second section of the tunnel), directly to the right of the far-left panel 500 (that includes the gauge 502) of the tunnel 102 includes a window 510 that provides a view inside the tunnel 102. The window 510 can be utilized by a user, such as a technician, to view the inside of the tunnel 102. The inside of the tunnel 102 can be viewed for troubleshooting to check for mechanical failure, check for visible contaminants that may or may not be present inside the tunnel 102, or any other reason. In some embodiments, a fan is provided within the tunnel 102 at the second panel 508. The fan can be used to circulate air within the ductwork from the particular tunnel 102 to a room serviced by the air handling device 100. In some embodiments, the second panel 508 further includes one or more hinges 512 and one or more handles 514 that allow the second panel 508 to be opened to access the interior of the tunnel 102. For example, the tunnel 102 can be opened to allow access for maintenance or replacement of the fan. As another example, the second panel 508 can merely be the access point to access the entirety of the interior of the tunnel 101.

As described herein, the discharge from the fan results in a more streamlined, efficient, and proportional air flow than current solutions. The structure of the tunnel 102 and location of the fan within the tunnel 102 allows the discharge from the fan to line up to the opening 506 that leads to the air select 104 and eventually the ductwork. For example, the fan and a coil provided herein are more closely sized, leading to a more linear and proportional air flow, which in turn increases efficiency of the air handling device 100 because the air flow discharge does not take up the entire area of the interior of the tunnel 102 as in current solutions.

A third panel 514 (corresponding to a third section of the tunnel), directly to the right of the second panel 508 as shown in FIG. 5A, includes an electrical power box 516. The electrical power box 516 provides and distributes power for the functioning of the tunnel 102 in this example. In some embodiments, each tunnel 102 includes a separate electrical power box 516, as shown in FIG. 5A. In other embodiments, a single electrical power box 516 provides and distributes power to more than one tunnel 102 within the air handling device 100. As shown in FIG. 5A, the electrical power box 516 is located on the exterior of the third panel 514 to provide more convenient access for maintenance and inspection. However, other embodiments are possible. For example, the electrical power box 516 can be provided inside the tunnel 102 without departing from the scope of the present disclosure.

Various elements described herein can be located on or inside the tunnel 102 at any panel level or section suitable for the proper functioning of the tunnel 102. For example, the gauge 502 illustrated on the first panel 500 can be provided on the second panel 508 to display various information and the electrical box 516 can be provided on the first panel 500 without affecting the function of the tunnel 102. Other features present in the tunnel, including but not limited to coils, sensors, a central processing unit (CPU), a voice activation device, filters, or any other features, can be provided in any suitable arrangement that enable the proper functioning of the air handling device and/or to perform one or more of the operations described herein. Additionally, the arrangement, positioning, configuration, etc. of the various components and sections can be varied as desired or needed.

FIG. 5B illustrates the two tunnels 102 of FIG. 5A implemented in a modular, two-by-two design according to various embodiments of the present disclosure. The perspective shown in FIG. 5B illustrates second openings 518 in the tunnels 102 distal to the first openings 506 adjacent to the first panel 500 described above. As shown in FIG. 5B, the second openings 518 include dampers 520 (which can be embodied or configured as the dampers 110) that can control the flow of air in or out of the tunnels 102. In some embodiments, the second openings 518 open into the second air select 106 described above and enable the return of air from a room, such as the OR, back to the tunnel 102.

In some embodiments, one or more of the tunnels 102 include a voice activation component that can be accessed from the room serviced by the particular tunnel 102. For example, as shown in FIG. 4, OR 2 can include a voice activation unit 410 that can be accessed by a user to control a function of the tunnel 102. For example, a user in OR 2 can command the tunnel 102 by speaking an initial command sequence, such as "Air Frame", "Air Handling Device", "Air Frame OR 2", etc. Following the initial command sequence, the user can control a function of the tunnel 102 using their voice. For example, the user can change the temperature of the room, activate or deactivate a disinfecting function, adjust lighting, turning on a particular camera or screen, etc. by using voice activation. In some embodiments, when the redundant tunnel 102 is activated for a particular room, the voice command function is transferred to the redundant tunnel 102 so the function of the voice activation by the user of the room is not interrupted. In other words, settings originally applied to the original tunnel 102 are also switched to the redundant tunnel 102 if and when the redundant tunnel 102 is activated.

In some embodiments, one or more of the tunnels 102 include an artificial intelligence (AI) component 412. For example, the AI component 412 can receive, process, and provide feedback to the air handling device 100 regarding settings for a particular room, user of a room, function of the room, etc. For example, the AI component 412 can learn that a particular room, such as OR 2, is set at a first humidifying setting for morning operations and a second humidifying setting for afternoon afternoons. As another example, the AI component 412 can learn that a particular user of a room, such as a particular doctor, prefers the room he or she is in to be at a particular temperature. Based on this, the AI component 412 can automatically set the temperature of a room to be used by the doctor using the tunnel 102 corresponding to the particular room. In some embodiments, when the redundant tunnel 102 is activated for a particular room, the AI component 412 is transferred to the redundant tunnel 102 so the function of the AI component 412 for the room is not interrupted. In other words, settings originally applied to the original tunnel 102 are also switched to the redundant tunnel 102 if and when the redundant tunnel 102 is activated.

In some embodiments, one or more of the tunnels 102 can be configured to record or include recording information that writes settings and functions to a memory for storage. The recorded information can include records of the conditions and settings provided and enabled twenty-four hours a day for each room serviced by the air handling device 100. By recording settings and function information, information such as all conditions during an operation, if and when doors were opened and closed, the number of people in the room at any given time, etc. can be saved and accessed later, if needed or desired. For example, when the room is an operating room, this provides automated, detailed record keeping for each operation that takes place in the operating room.

In some embodiments, one or more of the tunnels 102 include particulate sensing features (such as part of the air flow sensors 108 or as separate sensors) and disinfecting devices within each tunnel 102, such as, for example, vaporized hydrogen peroxide. If a reading on the sensor 108 exceeds a predetermined or variable threshold, a disinfectant mode can be triggered automatically, or an alarm can be set for manual activation. The particular room served by the affected tunnel 102 does not experience a lapse in service due to the presence of the redundant tunnel 102 that is activated and bypasses the original tunnel 102 while the original tunnel is in the disinfectant mode. Disinfection can take place in the sealed environment until a predetermined and acceptable elapsed time or particulate level is met. Conversely, the redundant tunnel 102 can be utilized as the disinfecting source and can provide VHP (or any other disinfecting method) to any other tunnel 102 that exceeds contamination thresholds that have been pre-determined. In this scenario, the source tunnel 102 is activated only after the contamination has been detected and the contaminated tunnel 102 has been closed off for disinfection.

In some embodiments, one or more of the tunnels 102 include a suite of sensors used for data collection. For example, one or more of the tunnels 102 can include sensors that measure one or more of temperature, humidity, pressure, air flow volume, air flow speed, and particulate levels that can be included for each individual tunnel 102 (and in some embodiments are functionality of the air flow sensor 108 or provided as separate sensors). The one or more sensors are communicatively coupled to an interpretation device, such as a processor, that converts the signals into a useable value that can be accessed via any protocol to a building management system or other device that can utilize the data or act as a standalone device with logging, storage, and viewing/playback capabilities as described herein. The tunnels 102 can also be used to receive feedback from sensors located in the rooms that are served by the air handling device 100 to automatically adjust one or more settings or operations according to the needs or desires corresponding to the space served.

In some embodiments, the air handling device 100 includes a piping manifold that chills water, hot water, steam, or any other liquid that can be supplied to an individual tunnel 102. The inclusion of the piping manifold simplifies piping by consolidating multiple smaller connections directly to the tunnels 100 into a single connection point at the manifold inlet.

In some embodiments, electrical connections for the individual tunnels 102 are prewired back to a load center that acts as a distribution device from the main's power input. Prewiring electrical connections back to the load center simplifies wiring in the field to a single connection to the main's power. Other "pre-configured" connections or interfaces are also contemplated for the multiple tunnels.

Various embodiments of the present disclosure further provide a modular arrangement that includes an external frame. The external frame includes extrusion pieces into which panels, such as those described in the description of FIGS. 5A and 5B, are inserted. This arrangement allows for alignment provisions within the extrusion to aid in quick and accurate stacking of the units (e.g., tunnels 102), a provision for a clamp to quickly affix units together, a designed in wire chase to reduce the need for conduit, a provision to accept bulb seals to create a positive seal between units, and creates coved internal corners for simplified cleaning inside the unit, as described in more detail below.

Figure 6A:
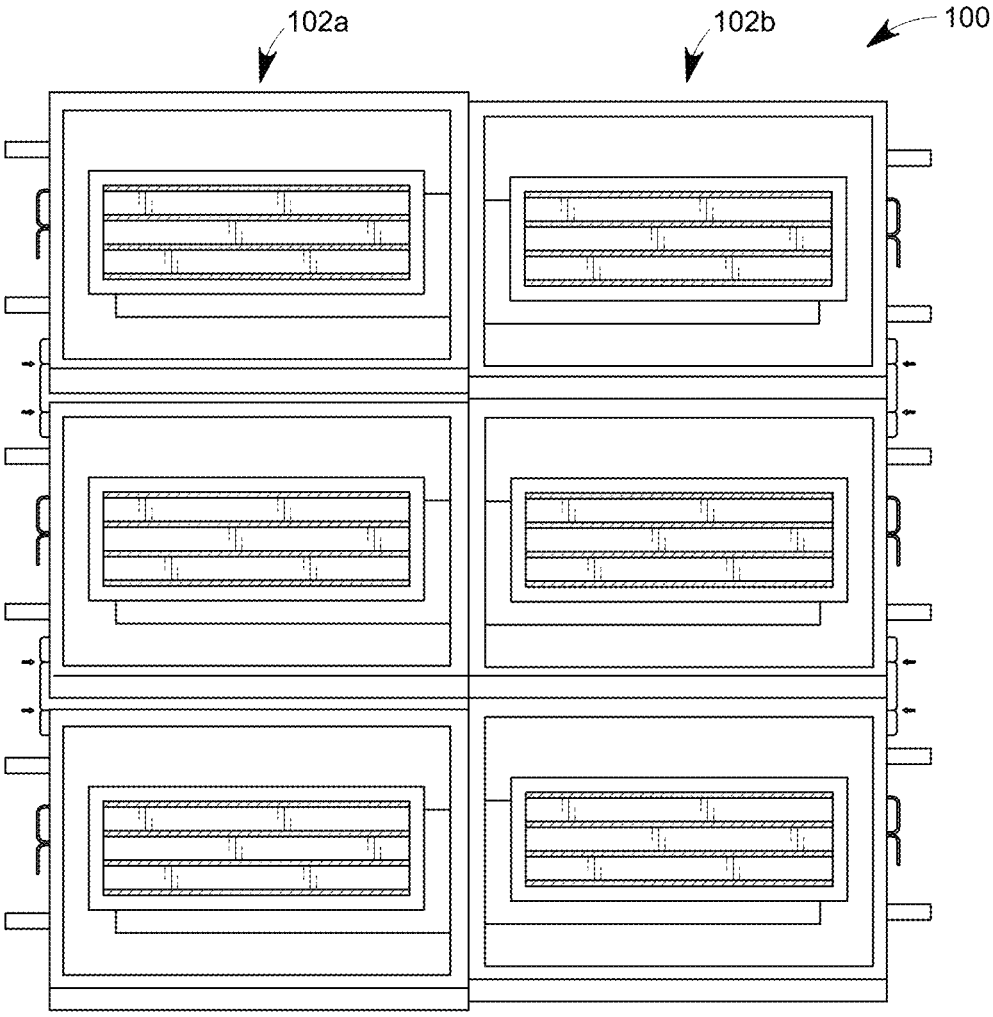
FIG. 6A illustrates an air handling device according to an implementation where some tunnels are not modularly connected.
Figure 6B:
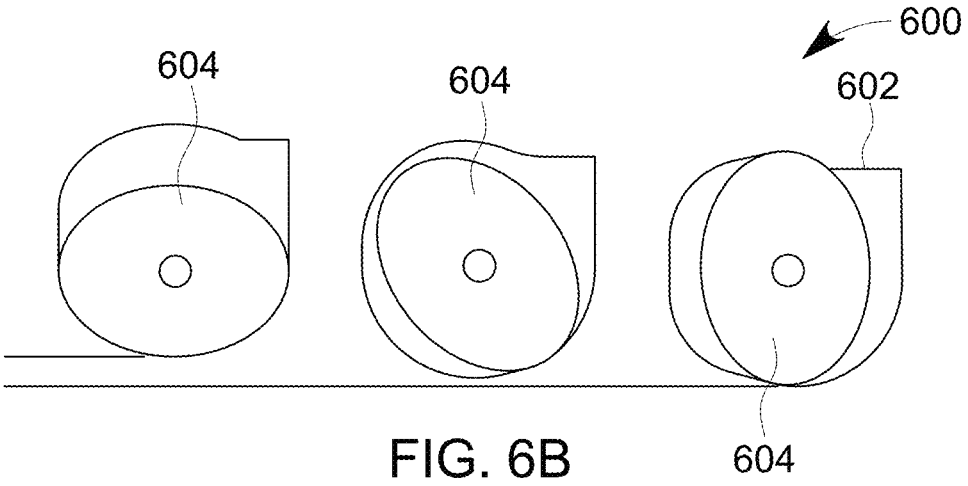
FIG. 6B illustrates a cam and shoulder bolt mechanism according to an implementation.
Figure 7A:
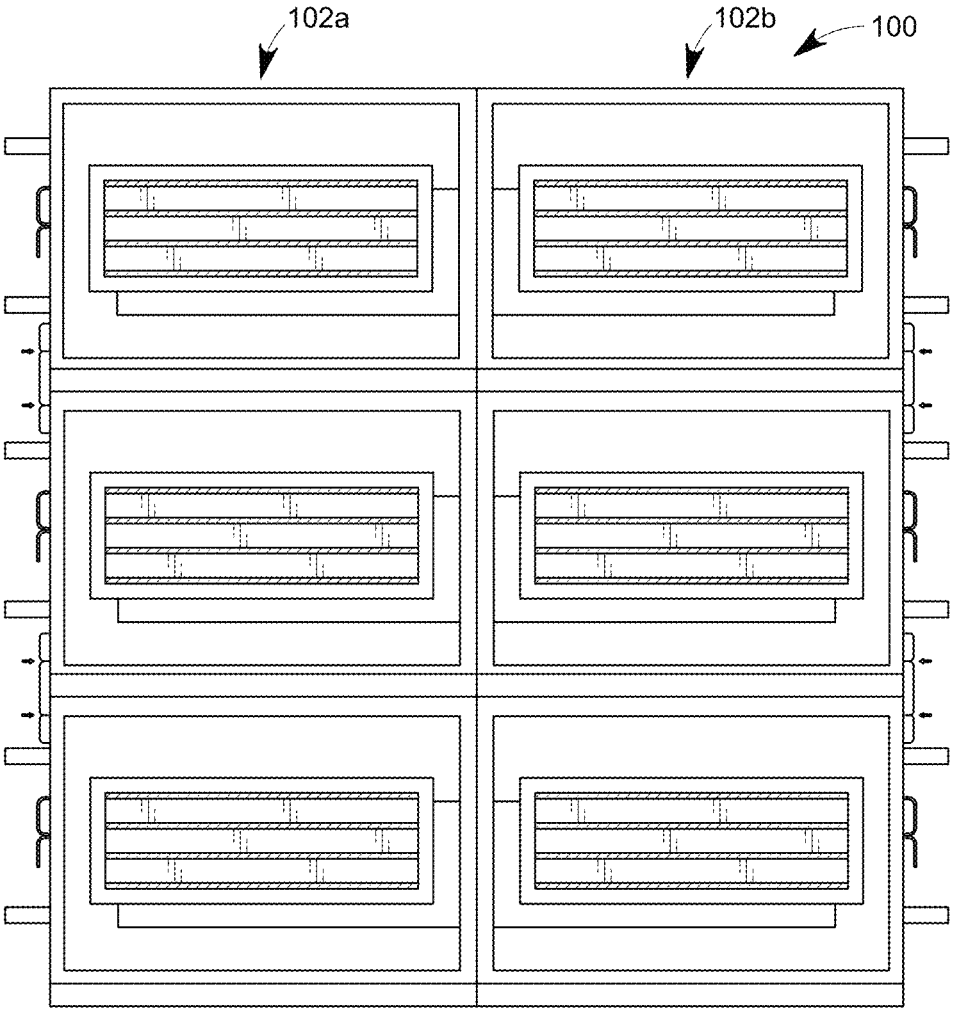
FIG. 7A illustrates the air handling device of FIG. 6A after the tunnels have been modularly connected.
Figure 7B:
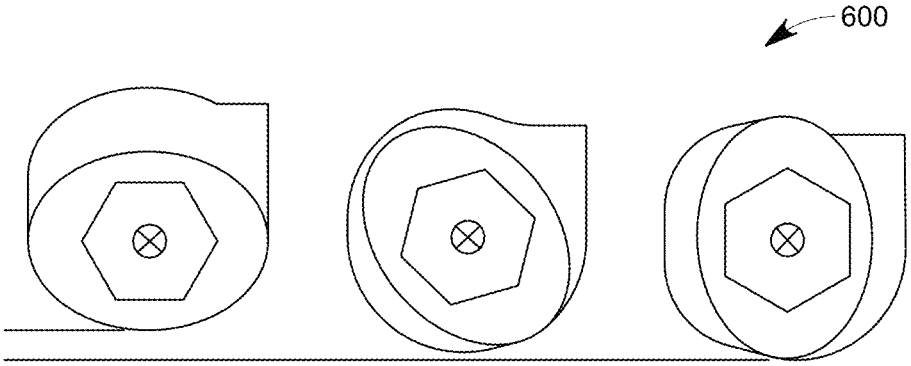
FIG. 7B illustrates the cam and shoulder mechanism of FIG. 6B after being tightened to modularly connect the tunnels of FIG. 7A.

In various embodiments, the air handling device 100 includes a modular construction that enables faster, more efficient assembly and installation. FIG. 6A illustrates an air handling device 100 where the tunnels 102*a* on the left side (as viewed in FIG. 6A) are not yet modularly connected, but the tunnels 102*b* on the right side are modularly connected. FIG. 6B illustrates a cam and shoulder bolt mechanism 600 with a positive stop 602 that is used to assemble the tunnels 102. FIG. 7A illustrates the air handling device 100 after the tunnels 102*a* on the left side have been modularly connected (as illustrated by the abutting arrangement having no gaps between the tunnels 102*a*). FIG. 7B illustrates the cam and shoulder mechanism 600 after being tightened to modularly connect the tunnels 102*a* on the left side.

Figure 8:
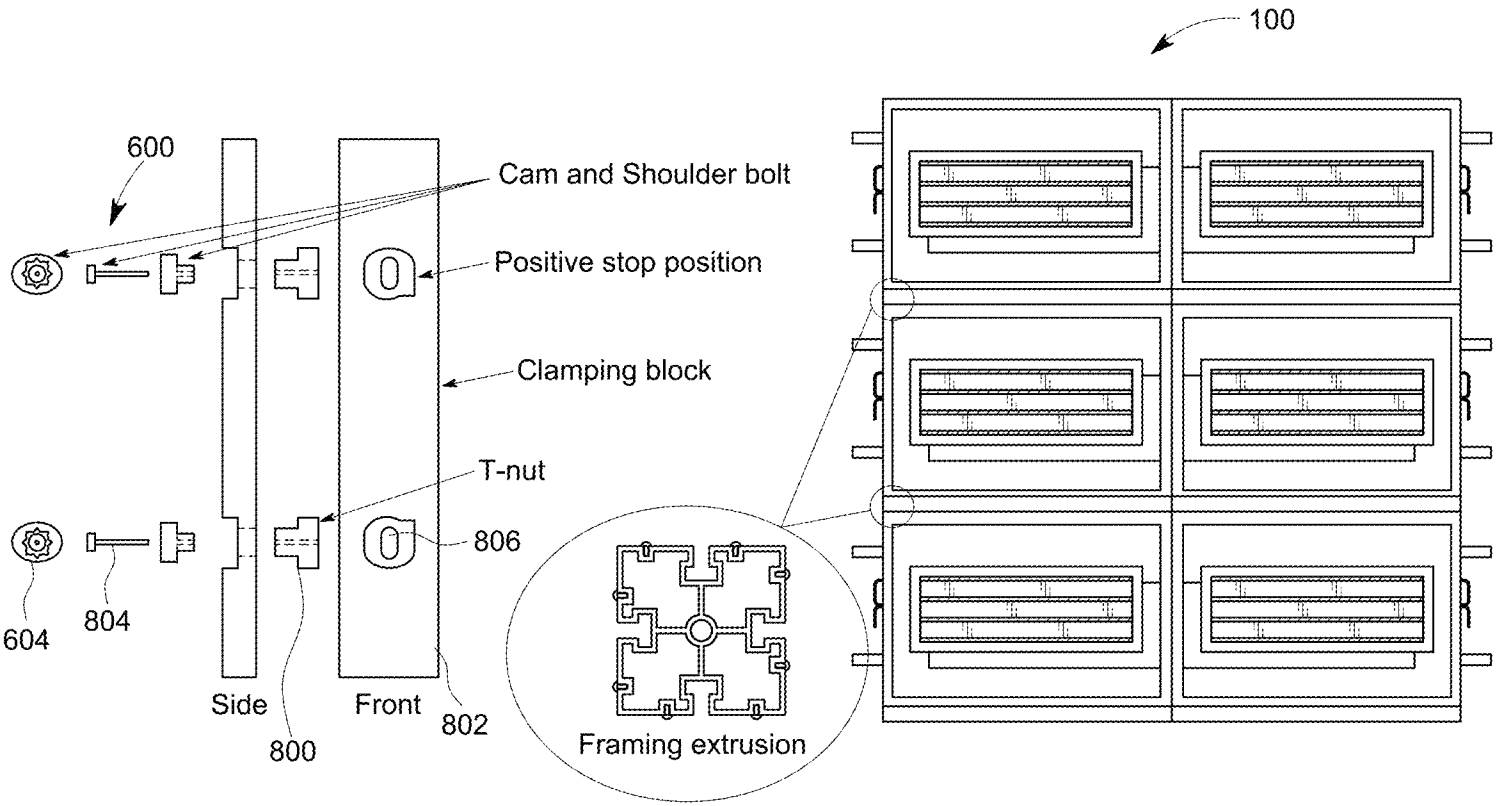
FIG. 8 is another diagram illustrating a cam and shoulder bolt mechanism according to an implementation.

As a cam 604 in FIG. 6B is pulled, the tunnel units are pulled tightly together and aligned through a T-nut 800 and clamping or fixing block 802 in an extrusion profile. As shown in FIG. 8, a shoulder bolt 804 fits through an opening 806 in the cam 604. The shoulder bolt 804 is inserted into the T-nut 800 and rotated into a positive stop position in the clamping block 802 to secure the tunnel 102 units together. The shoulder bolt 804 includes a space such that the cam can 604 be inserted through and tightened to lock the extrusion frame in place. It should be noted that in one example, the head of the cam has a "star" shaped configuration of the opening through which the bolt 804 is inserted. However, other shapes and configurations are contemplated.

Figure 9:
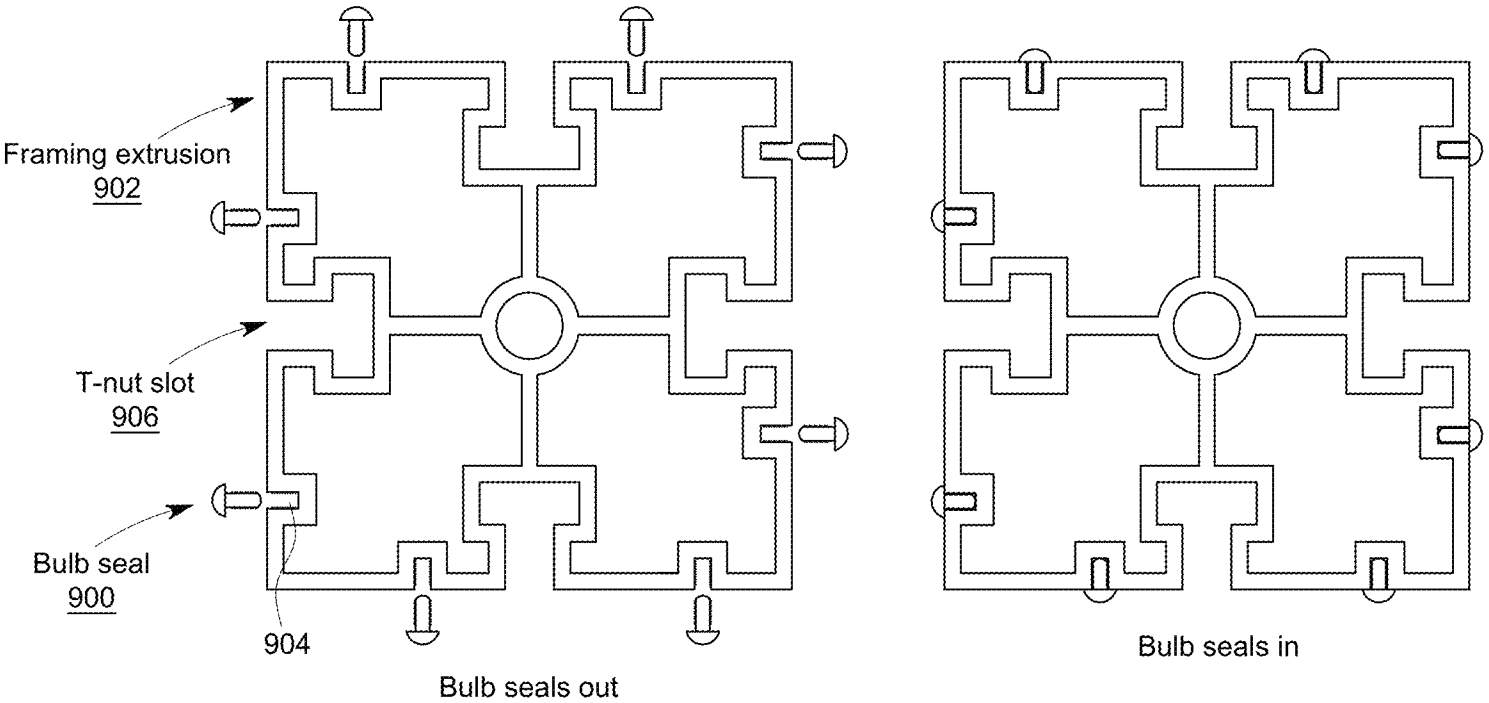
FIG. 9 illustrates a bulb seal on an air handling device according to various embodiments.
Figure 10:
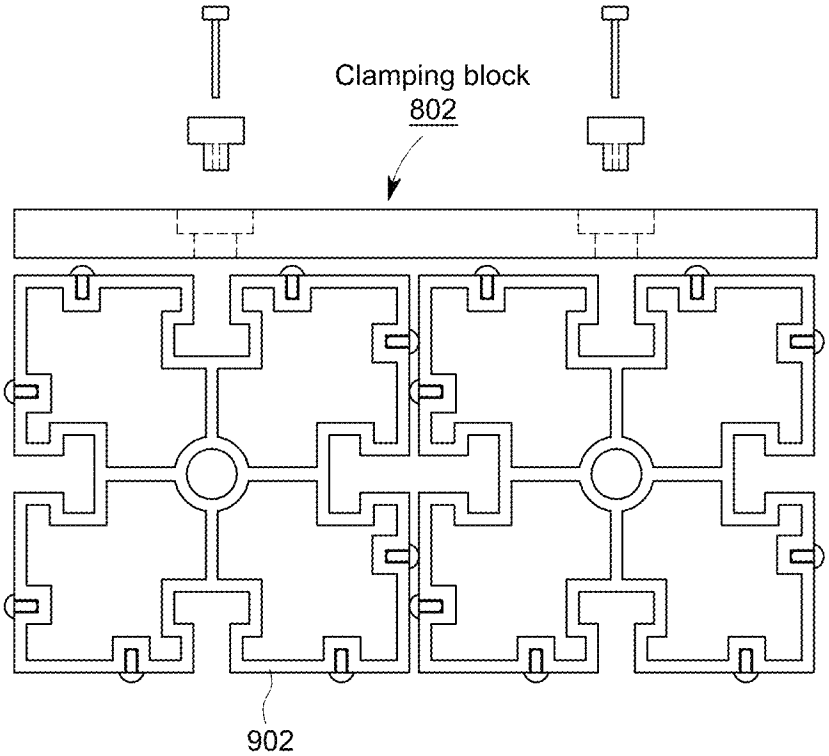
FIG. 10 illustrates the bulb seal in an installed state according to various embodiments.
Figure 10:
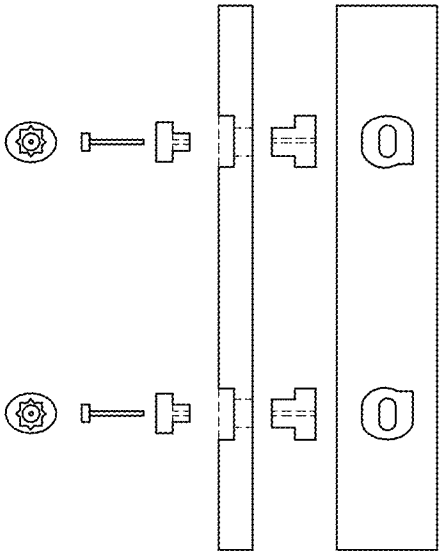

FIG. 9 illustrates a bulb seal 900 on the air handling device 100 according to various embodiments of the present disclosure. The bulb seal 900 is inserted into or out of a framing extrusion 902 that frames the exterior and seals the unit (tunnel 102) to prevent contamination. In some embodiments, the bulb seal 900 comprises neoprene or a similar construction that is pushed into slots 904. Following the bulb seal 900 being pushed or inserted into the slots 904, the clamping of fixing block 802 is placed on top of the framing extrusion 902, as shown in FIG. 10, and connected via the mechanism described in the description of FIGS. 6A-7B. As shown in FIG. 10, the bulb seal track is positioned to prevent the bulb seals 900 from contacting, and therefore interfering with, one another.

In some embodiments, the framing extrusion 902 is designed to allow a solid structure, such as sheet metal, to be inserted to increase the rigidity of the frame structure or to act as a wall in order to separate the tunnels 102 or components from one another. It should be noted that the configuration and shape of the framing extrusion 902 can be modified as desired or needed, such as to have a different shape than the square shaped configuration illustrated.

Figure 11:
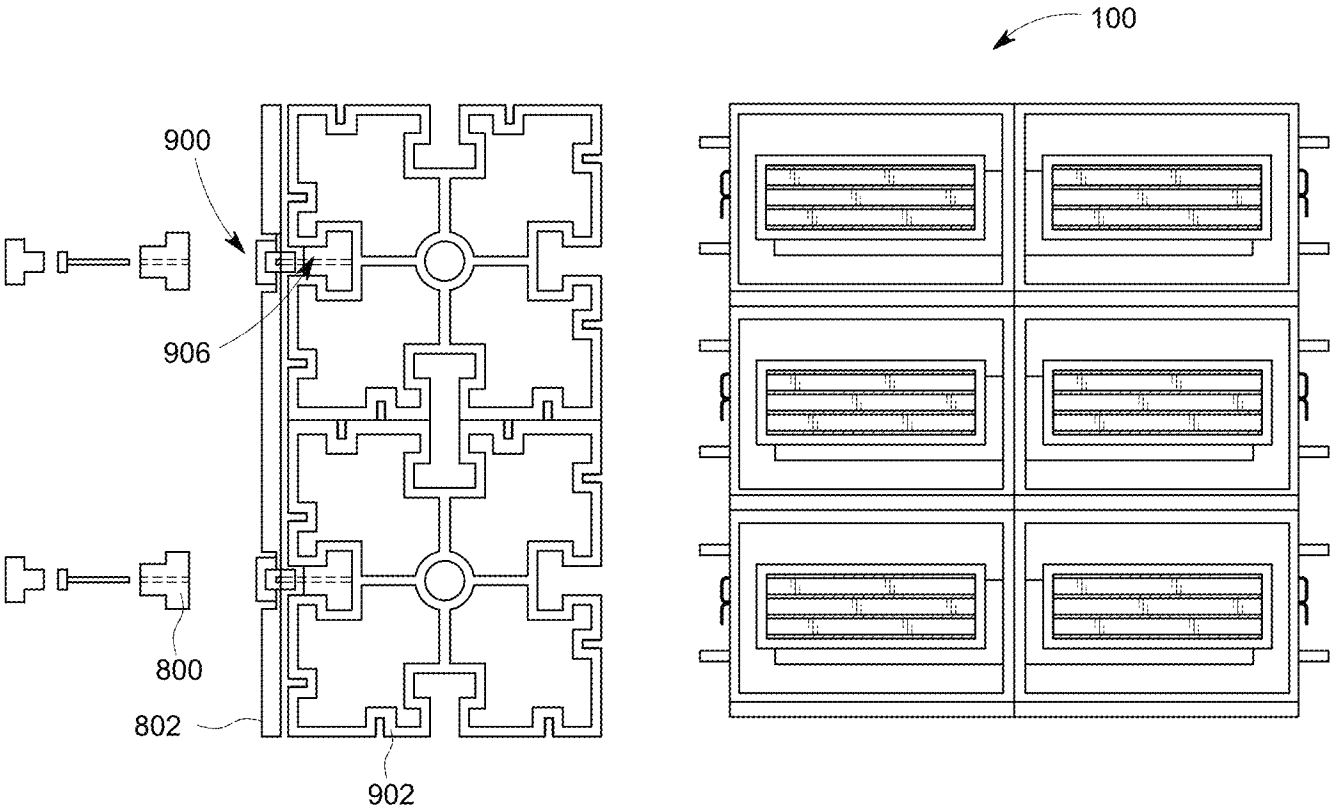
FIG. 11 is another illustration of a cam and shoulder bolt mechanism holding a clamping block in place over a bulb seal.

FIG. 11 is another illustration of the cam and shoulder bolt mechanism 600 holding the clamping of fixing block 802 in place over the bulb seal 900. As illustrated in FIG. 11, the T-nut 800 is inserted into the T-nut slot 906 (illustrated as a T-slot having a T-shape) and the cam and shoulder bolt mechanism 600 hold the clamping of fixing block 802 in place over the T-nut 800 and bulb seal 900.

Figure 12A:
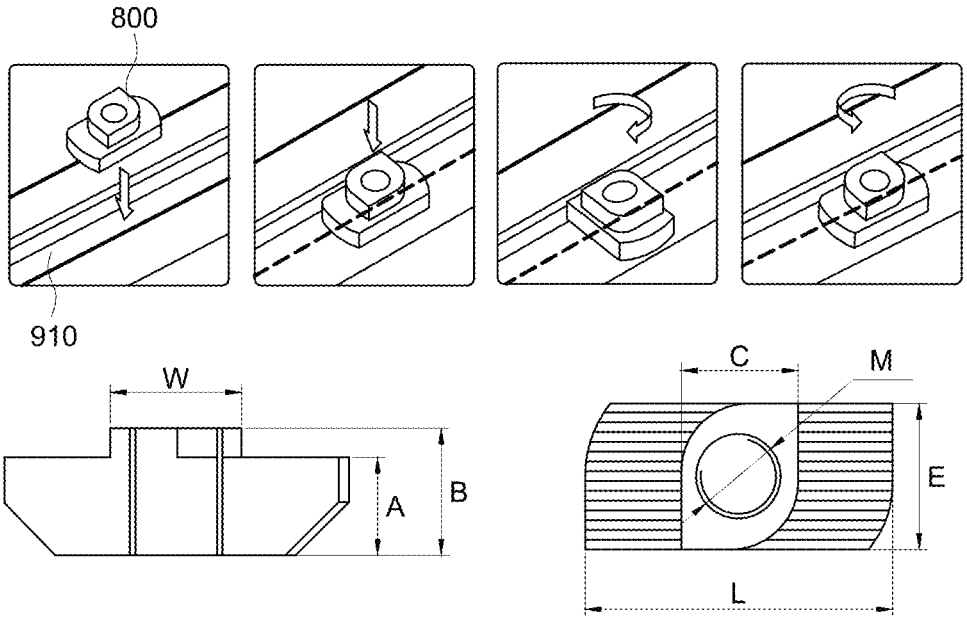
FIGS. 12A and 12B illustrate a T-nut and a T-slot according to various embodiments.
Figure 12B:
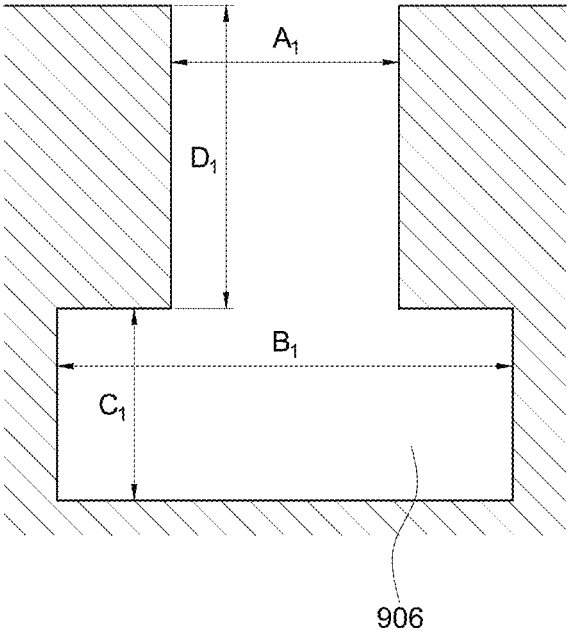

FIGS. 12A and 12B illustrate the T-nut 800 and T-nut slot 906 according to various embodiments of the present disclosure. As shown in FIG. 12A, the T-nut 800 can be inserted into a groove 910 in the T-nut slot 906 such that the T-nut 800 is parallel to the groove 910 in the T-nut slot 906. Once in the groove 910, the T-nut 800 can be rotated such that the T-nut 800 is perpendicular to the groove 910 of the T-nut slot 906, locking the T-nut 800 into place in the T-nut slot 906. From there, the T-nut 800 can be tightened down to prevent dislodgement. When each T-nut 800 is tightened into the corresponding T-nut slot 906, the individual tunnels 102 of the air handling device 100 are modularly arranged together. The modular arrangement described herein minimizes the amount of time needed to assemble the air handling device 100. Furthermore, the modular arrangement of the air handling device 100 requires less space to assemble and install than traditional air handling units, cutting down on the footprint of the unit itself in various examples. This can save financial and storage resources.

In some embodiments, the air handling device 100 can be locked in to place by a latch, such as a butterfly latch. In these embodiments, the air handling device 100 can be installed without customary tools, which provides for more accessible maintenance and installation. For example, when the modular arrangement of the air handling device 100 is locked into place using the butterfly latch, the individual components such as clamping or fixing block 802, the framing extrusion 902, and bulb seal 900 are aligned, and the latch is clamped.

Thus, one or more embodiments provide a modular air handling device that allows for redundancy.

Figure 13:
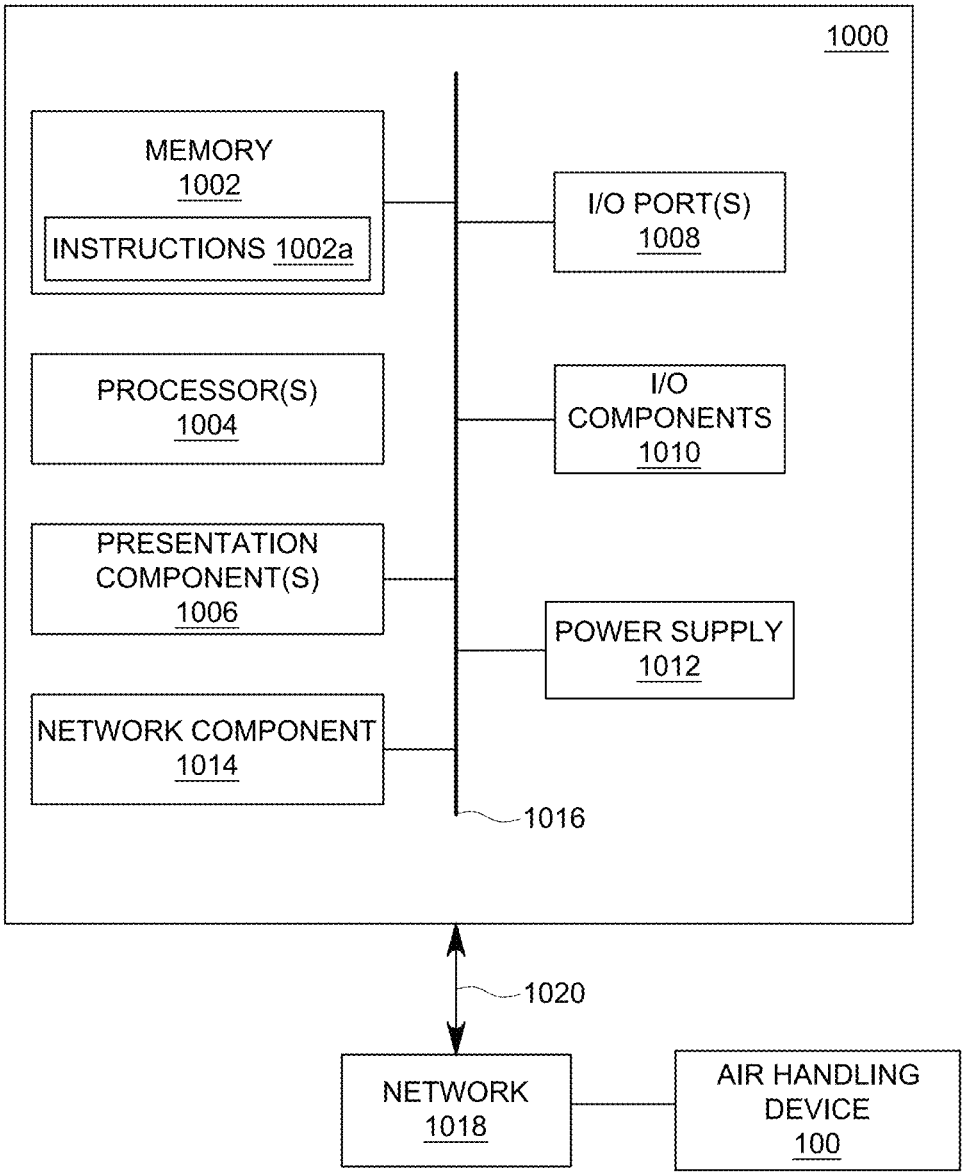
FIG. 13 is a block diagram of an example computing environment suitable for implementing various embodiments.

With reference now to FIG. 13, a block diagram of a computing device 1000 suitable for implementing various aspects of the disclosure as described (e.g., communicating with one or more sensors of the air handling device 100 or generating control signals to control one or more operations or functions of the air handling device 100). It should be noted that the computing device 1000 or a portion thereof can be communicatively coupled to the air handling device 100 or form part of the air handling device 100. FIG. 13 and the following discussion provide a brief, general description of a computing environment in/on which one or more or the implementations of one or more of the methods and/or system set forth herein may be implemented. The operating environment of FIG. 13 is merely an example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, mobile consoles, tablets, media players, and the like), multiprocessor systems, consumer electronics, mini computers, mainframe computers, distributed computing environments that include any of the above systems or devices, and the like.

Although not required, implementations are described in the general context of "computer readable instructions" executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

In some examples, the computing device 1000 includes a memory 1002, one or more processors 1004, and one or more presentation components 1006 (e.g., displays). The disclosed examples associated with the computing device 1000 are practiced by a variety of computing devices, including personal computers, laptops, smart phones, mobile tablets, hand-held devices, consumer electronics, specialty computing devices, etc. Distinction is not made between such categories as "workstation," "server," "laptop," "hand-held device," etc., as all are contemplated within the scope of FIG. 13 and the references herein to a "computing device." The disclosed examples are also practiced in distributed computing environments, where tasks are performed by remote-processing devices that are linked through a communications network. Further, while the computing device 1000 is depicted as a single device, in one example, multiple computing devices work together and share the depicted device resources. For instance, in one example, the memory 1002 is distributed across multiple devices, the processor(s) 1004 provided are housed on different devices, and so on.

In one example, the memory 1002 includes any of the computer-readable media discussed herein. In one example, the memory 1002 is used to store and access instructions 1002*a* configured to carry out the various operations disclosed herein. In some examples, the memory 1002 includes computer storage media in the form of volatile and/or nonvolatile memory, removable or non-removable memory, data disks in virtual environments, or a combination thereof. In one example, the processor(s) 1004 includes any quantity of processing units that read data from various entities, such as the memory 1002 or input/output (I/O) components 1010. Specifically, the processor(s) 1004 are programmed to execute computer-executable instructions for implementing aspects of the disclosure. In one example, the instructions 1002*a* are performed by the processor 1004, by multiple processors within the computing device 1000, or by a processor external to the computing device 700. In some examples, the processor(s) 1004 are programmed to execute instructions such as those illustrated in the flow charts discussed herein and depicted in the accompanying drawings.

In other implementations, the computing device 1000 may include additional features and/or functionality. For example, the computing device 1000 may also include additional storage (e.g., removable and/or non-removable) including, but not limited to, magnetic storage, optical storage, and the like. Such additional storage is illustrated in FIG. 13 by the memory 1002. In one implementation, computer readable instructions to implement one or more implementations provided herein may be in the memory 1002 as described herein. The memory 1002 may also store other computer readable instructions to implement an operating system, an application program and the like. Computer readable instructions may be loaded in the memory 1002 for execution by the processor(s) 1004, for example.

The presentation component(s) 1006 present data indications to an operator or to another device. In one example, the presentation components 1006 include a display device, speaker, printing component, vibrating component, etc. One skilled in the art will understand and appreciate that computer data is presented in a number of ways, such as visually in a graphical user interface (GUI), audibly through speakers, wirelessly between the computing device 1000, across a wired connection, or in other ways. In one example, the presentation component(s) 1006 are not used when processes and operations are sufficiently automated that a need for human interaction is lessened or not needed. I/O ports 1008 allow the computing device 1000 to be logically coupled to other devices including the I/O components 1010, some of which is built in. Implementations of the I/O components 1010 include, for example but without limitation, a microphone, keyboard, mouse, joystick, pen, game pad, satellite dish, scanner, printer, wireless device, camera, etc.

The computing device 1000 includes a bus 1016 that directly or indirectly couples the following devices: the memory 1002, the one or more processors 1004, the one or more presentation components 1006, the input/output (I/O) ports 1008, the I/O components 1010, a power supply 1012, and a network component 1014. The computing device 1000 should not be interpreted as having any dependency or requirement related to any single component or combination of components illustrated therein. The bus 1016 represents one or more busses (such as an address bus, data bus, or a combination thereof). Although the various blocks of FIG. 12 are shown with lines for the sake of clarity, some implementations blur functionality over various different components described herein.

The components of the computing device 1000 may be connected by various interconnects. Such interconnects may include a Peripheral Component Interconnect (PCI), such as PCI Express, a Universal Serial Bus (USB), firewire (IEEE 1394), an optical bus structure, and the like. In another implementation, components of the computing device 1000 may be interconnected by a network. For example, the memory 1002 may be comprised of multiple physical memory units located in different physical locations interconnected by a network.

In some examples, the computing device 1000 is communicatively coupled to a network 1018 using the network component 1014. In some examples, the network component 1014 includes a network interface card and/or computer-executable instructions (e.g., a driver) for operating the network interface card. In one example, communication between the computing device 1000 and other devices occurs using any protocol or mechanism over a wired or wireless connection 1020. In some examples, the network component 1014 is operable to communicate data over public, private, or hybrid (public and private) connections using a transfer protocol, between devices wirelessly using short range communication technologies (e.g., near-field communication (NFC), Bluetooth® branded communications, or the like), or a combination thereof.

The connection 1020 may include, but is not limited to, a modem, a Network Interface Card (NIC), an integrated network interface, a radio frequency transmitter/receiver, an infrared port, a USB connection or other interfaces for connecting the computing device 1000 to other computing devices. The connection 1020 may transmit and/or receive communication media.

Although described in connection with the computing device 1000, examples of the disclosure are capable of implementation with numerous other general-purpose or special-purpose computing system environments, configurations, or devices. Implementations of well-known computing systems, environments, and/or configurations that are suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, set top boxes, programmable consumer electronics, mobile telephones, mobile computing and/or communication devices in wearable or accessory form factors (e.g., watches, glasses, headsets, or earphones), network PCs, minicomputers, mainframe computers, distributed computing environments that include any of the above systems or devices, VR devices, holographic device, and the like. Such systems or devices accept input from the user in any way, including from input devices such as a keyboard or pointing device, via gesture input, proximity input (such as by hovering), and/or via voice input.

Implementations of the disclosure, such as controllers or monitors, are described in the general context of computer-executable instructions, such as program modules, executed by one or more computers or other devices in software, firmware, hardware, or a combination thereof. In one example, the computer-executable instructions are organized into one or more computer-executable components or modules. Generally, program modules include, but are not limited to, routines, programs, objects, components, and data structures that perform particular tasks or implement particular abstract data types. In one example, aspects of the disclosure are implemented with any number and organization of such components or modules. For example, aspects of the disclosure are not limited to the specific computer-executable instructions or the specific components or modules illustrated in the figures and described herein. Other examples of the disclosure include different computer-executable instructions or components having more or less functionality than illustrated and described herein. In implementations involving a general-purpose computer, aspects of the disclosure transform the general-purpose computer into a special-purpose computing device when configured to execute the instructions described herein.

By way of example and not limitation, computer readable media comprises computer storage media and communication media. Computer storage media include volatile and nonvolatile, removable, and non-removable memory implemented in any method or technology for storage of information such as computer readable instructions, data structures, program modules, or the like. Computer storage media are tangible and mutually exclusive to communication media. Computer storage media are implemented in hardware and exclude carrier waves and propagated signals. Computer storage media for purposes of this disclosure are not signals per se. In one example, computer storage media include hard disks, flash drives, solid-state memory, phase change random-access memory (PRAM), static random-access memory (SRAM), dynamic random-access memory (DRAM), other types of random-access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium used to store information for access by a computing device. In contrast, communication media typically embody computer readable instructions, data structures, program modules, or the like in a modulated data signal such as a carrier wave or other transport mechanism and include any information delivery media.

While various spatial and directional terms, including but not limited to top, bottom, lower, mid, lateral, horizontal, vertical, front and the like are used to describe the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Various operations of implementations are provided herein. In one implementation, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each implementation provided herein.

Any range or value given herein can be extended or altered without losing the effect sought, as will be apparent to the skilled person.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

As used in this application, the terms "component," "module," "system," "interface," and the like are generally intended to refer to a computer-related entity, either hardware, a combination of hardware and software, software, or software in execution. For example, a component may be, but is not limited to being, a process running on a processor, a processor, an object, an executable, a thread of execution, a program and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device, carrier or media. Of course, those skilled in the art will recognize many modifications may be made to this configuration without departing from the scope or spirit of the claimed subject matter.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

A computing device suitable for implementing various aspects of the disclosure (e.g., one or more controllers) is described. In some examples, the computing device includes one or more processors, one or more presentation components and the memory. The disclosed examples associated with the computing device are practiced by a variety of computing devices, including personal computers, laptops, smart phones, mobile tablets, hand-held devices, consumer electronics, specialty computing devices, etc. Distinction is not made between such categories as "workstation," "server," "laptop," "hand-held device," etc., as all are contemplated within the scope of the computing device and the references herein to a "computing device." The disclosed examples are also practiced in distributed computing environments, where tasks are performed by remote-processing devices that are linked through a communications network. Further, while the computing device is depicted as a seemingly single device, in one example, multiple computing devices work together and share the depicted device resources. For instance, in one example, the memory is distributed across multiple devices, the processor(s) provided are housed on different devices, and so on.

In one example, the memory includes any of the computer-readable media discussed herein. In one example, the memory is used to store and access instructions configured to carry out the various operations disclosed herein. In some examples, the memory includes computer storage media in the form of volatile and/or nonvolatile memory, removable or non-removable memory, data disks in virtual environments, or a combination thereof. In one example, the processor(s) includes any quantity of processing units that read data from various entities, such as the memory or input/output (I/O) components. Specifically, the processor(s) are programmed to execute computer-executable instructions for implementing aspects of the disclosure. In one example, the instructions are performed by the processor, by multiple processors within the computing device, or by a processor external to the computing device. In some examples, the processor(s) are programmed to execute instructions such as those illustrated in the flow charts discussed below and depicted in the accompanying drawings.

The presentation component(s) present data indications to an operator or to another device. In one example, presentation components include a display device, speaker, printing component, vibrating component, etc. One skilled in the art will understand and appreciate that computer data is presented in a number of ways, such as visually in a graphical user interface (GUI), audibly through speakers, wirelessly between the computing device, across a wired connection, or in other ways. In one example, presentation component(s) are not used when processes and operations are sufficiently automated that a need for human interaction is lessened or not needed. I/O ports allow the computing device to be logically coupled to other devices including the I/O components, some of which is built in. Implementations of the I/O components include, for example but without limitation, a microphone, keyboard, mouse, joystick, game pad, satellite dish, scanner, printer, wireless device, etc.

The computing device includes a bus that directly or indirectly couples the following devices: the memory, the one or more processors, the one or more presentation components, the input/output (I/O) ports, the I/O components, a power supply, and a network component. The computing device should not be interpreted as having any dependency or requirement related to any single component or combination of components illustrated therein. The bus represents one or more busses (such as an address bus, data bus, or a combination thereof).

In some examples, the computing device is communicatively coupled to a network using the network component. In some examples, the network component includes a network interface card and/or computer-executable instructions (e.g., a driver) for operating the network interface card. In one example, communication between the computing device and other devices occur using any protocol or mechanism over a wired or wireless connection. In some examples, the network component is operable to communicate data over public, private, or hybrid (public and private) using a transfer protocol, between devices wirelessly using short range communication technologies (e.g., near-field communication (NFC), Bluetooth® branded communications, or the like), or a combination thereof.

Although described in connection with the computing device, examples of the disclosure are capable of implementation with numerous other general-purpose or special-purpose computing system environments, configurations, or devices. Implementations of well-known computing systems, environments, and/or configurations that are suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, set top boxes, programmable consumer electronics, mobile telephones, mobile computing and/or communication devices in wearable or accessory form factors (e.g., watches, glasses, headsets, or earphones), network PCs, minicomputers, mainframe computers, distributed computing environments that include any of the above systems or devices, VR devices, holographic device, and the like. Such systems or devices accept input from the user in any way, including from input devices such as a keyboard or pointing device, via gesture input, proximity input (such as by hovering), and/or via voice input.

Implementations of the disclosure are described in the general context of computer-executable instructions, such as program modules, executed by one or more computers or other devices in software, firmware, hardware, or a combination thereof. In one example, the computer-executable instructions are organized into one or more computer-executable components or modules. Generally, program modules include, but are not limited to, routines, programs, objects, components, and data structures that perform particular tasks or implement particular abstract data types. In one example, aspects of the disclosure are implemented with any number and organization of such components or modules. For example, aspects of the disclosure are not limited to the specific computer-executable instructions or the specific components or modules illustrated in the figures and described herein. Other examples of the disclosure include different computer-executable instructions or components having more or less functionality than illustrated and described herein. In implementations involving a general-purpose computer, aspects of the disclosure transform the general-purpose computer into a special-purpose computing device when configured to execute the instructions described herein.

By way of example and not limitation, computer readable media comprise computer storage media and communication media. Computer storage media include volatile and nonvolatile, removable, and non-removable memory implemented in any method or technology for storage of information such as computer readable instructions, data structures, program modules, or the like. Computer storage media are tangible and mutually exclusive to communication media. Computer storage media are implemented in hardware and exclude carrier waves and propagated signals. Computer storage media for purposes of this disclosure are not signals per se. In one example, computer storage media include hard disks, flash drives, solid-state memory, phase change random-access memory (PRAM), static random-access memory (SRAM), dynamic random-access memory (DRAM), other types of random-access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium used to store information for access by a computing device. In contrast, communication media typically embody computer readable instructions, data structures, program modules, or the like in a modulated data signal such as a carrier wave or other transport mechanism and include any information delivery media.

Although examples described herein are described in connection with a particular air handling arrangement and environment, the present disclosure can be implemented in different arrangements and in different environments. For example, the present disclosure is implementable in any application or environment in which air flow control is desired.

The examples disclosed herein are described in the general context of computer code or machine-useable instructions, including computer-executable instructions such as program components, being executed by a computer or other machine, such as a personal data assistant or other handheld device. Generally, program components including routines, programs, objects, components, data structures, and the like, refer to code that performs particular tasks, or implement particular abstract data types. The disclosed examples are practiced in a variety of system configurations, including personal computers, laptops, smart phones, mobile tablets, hand-held devices, consumer electronics, specialty computing devices, etc. The disclosed examples are also practiced in distributed computing environments, where tasks are performed by remote-processing devices that are linked through a communications network.

When introducing elements of aspects of the disclosure or the implementations thereof, the articles "a," "an," "the," and "said" are intended to mean that there are one or more of the elements. The terms "comprising," "including," and "having" are intended to be inclusive and mean that there could be additional elements other than the listed elements. The term "implementation" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

Although particular aspects and embodiments have been shown and described, it should be understood that the above discussion is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims.

Where methods described above indicate certain events occurring in certain order, those of ordinary skill in the art having the benefit of this disclosure would recognize that the ordering may be modified and that such modifications are in accordance with the variations of the present disclosure. Additionally, parts of methods may be performed concurrently in a parallel process when possible, as well as performed sequentially. In addition, more steps or less steps of the methods may be performed.

Accordingly, embodiments are intended to exemplify alternatives, modifications, and equivalents that may fall within the scope of the claims.

Although certain illustrative embodiments and methods have been disclosed herein, it can be apparent from the foregoing disclosure to those skilled in the art that variations and modifications of such embodiments and methods can be made without departing from the true spirit and scope of this disclosure. Many other examples exist, each differing from others in matters of detail only.

What is claimed is:

1. An air handling device, comprising:

a plurality of tunnels defining a plurality of separate air flow pathways, wherein at least one tunnel of the plurality of tunnels is an active tunnel and at least one tunnel of the plurality of tunnels is a redundant tunnel;

a first air select at a first end of the plurality of tunnels;

a second air select on a second end of the plurality of tunnels, the first end being opposite to the second end; and a plurality of dampers within each of the first and second air selects, the plurality of dampers configured to change an air flow therein to block air flow through the active tunnel and allow air flow through the redundant tunnel, wherein at least one damper of the plurality of dampers in each of the first and second air selects is in air flow communication with a corresponding one of the tunnels of the plurality of tunnels and another damper of the plurality of dampers in each of the first and second air selects is in air flow communication with a damper of the plurality of dampers in an adjacent one of the first and second air selects.

2. The air handling device of claim 1, wherein the plurality of dampers are configured to control air flow (i) into and out of the plurality of tunnels and (ii) between the plurality of tunnels.

3. The air handling device of claim 1, wherein the plurality of dampers include at least one damper associated with each tunnel of the plurality of dampers.

4. The air handling device of claim 1, wherein each tunnel of the plurality of tunnels comprises one or more control components and one or more monitoring components.

5. The air handling device of claim 1, wherein the plurality of tunnels are configured in a stacked arrangement interconnected by a cam and shoulder bolt mechanism.

6. The air handling device of claim 5, wherein the cam and shoulder bolt mechanism is configured to engage a clamping block and coupled to a framing extrusion having a t-nut slot.

7. The air handling device of claim 6, further comprising a plurality of bulb seals arranged between the clamping block and the framing extrusion.

8. The air handling device of claim 7, wherein the framing extrusion comprises a plurality of T-nut slots.

9. The air handling device of claim 5, wherein the cam and shoulder bolt mechanism comprises a positive stop.

10. The air handling device of claim 5, wherein the cam and shoulder bolt mechanism comprise a cam having a head with a star shaped configuration opening configured to receive a bolt therein.

11. The air handling device of claim 1, further comprising a controller configured to automatically control plurality of dampers.

12. The air handling device of claim 11, wherein the first air select is configured to monitor and control an output of air from each tunnel of the plurality of tunnels and the second air select is configured to monitor and control a return of air to each tunnel of the plurality of tunnels, and the controller is configured receive feedback from at least one of the first air select and the second air select and in response, control one or more dampers of the plurality of dampers to selectively control air flow of the plurality of tunnels.

13. The air handling device of claim 12, wherein each tunnel of the plurality of tunnels is connected to a separate operating room.

14. The air handling device of claim 12, further comprising an artificial intelligence (AI) component configured to learn one or more settings with respect to one or more rooms connected to one or more of the plurality of tunnels.

15. The air handling device of claim 14, wherein one or more settings applied to the active tunnel are switched to the redundant tunnel in response to the change of the air flow to block air flow through the active tunnel and allow air flow through the redundant tunnel.

16. The air handling device of claim 1, wherein the plurality of tunnels comprises a plurality of active tunnels.

17. The air handling device of claim 1, wherein the plurality of tunnels comprises a plurality of redundant tunnels.

18. The air handling device of claim 1, wherein each tunnel of the plurality of tunnels comprises a window allowing a view inside the tunnel.

19. An air handling device, comprising:

a plurality of tunnels defining a plurality of separate air flow pathways, wherein at least one tunnel of the plurality of tunnels is an active tunnel and at least one tunnel of the plurality of tunnels is a redundant tunnel; and a controller configured to automatically change air flow with respect to the plurality of tunnels in response to a received feedback indicating a tunnel failure or a tunnel contamination has occurred in the active tunnel, the change in air flow blocking air flow through the active tunnel and allowing air flow through the redundant tunnel, wherein the redundant tunnel is a backup tunnel only used in response to the indication of the tunnel failure or the tunnel contamination.

20. The air handling device of claim 19, wherein the controller is configured to learn one or setting or a user or a room associated with one or more tunnels of the plurality or tunnels.

* * * * *